US010176751B2

(12) United States Patent
Yamamoto et al.

(10) Patent No.: US 10,176,751 B2
(45) Date of Patent: Jan. 8, 2019

(54) DRIVE CIRCUIT

(71) Applicant: JOLED INC., Tokyo (JP)

(72) Inventors: Tetsuro Yamamoto, Tokyo (JP); Hiroshi Fujimura, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 15/863,290

(22) Filed: Jan. 5, 2018

(65) Prior Publication Data

US 2018/0197464 A1 Jul. 12, 2018

(30) Foreign Application Priority Data

Jan. 12, 2017 (JP) ..... 2017-003702

(51) Int. Cl.
*G09G 3/3208* (2016.01)

(52) U.S. Cl.
CPC ... *G09G 3/3208* (2013.01); *G09G 2310/0291* (2013.01); *G09G 2310/08* (2013.01)

(58) Field of Classification Search
CPC ..... G09G 3/3208; G09G 2310/0291; G09G 2310/08
See application file for complete search history.

(56) References Cited

U.S. PATENT DOCUMENTS

2011/0057687 A1* 3/2011 Nakagawa ..... G11C 7/1078 327/108

FOREIGN PATENT DOCUMENTS

JP 04340809 A * 11/1992
JP 2005-189680 7/2005

* cited by examiner

*Primary Examiner* — Rodney Amadiz
(74) *Attorney, Agent, or Firm* — Greenblum & Bernstein, P.L.C.

(57) ABSTRACT

A drive circuit having an output terminal includes a buffer circuit including a first transistor and a second transistor that are connected in parallel between a power supply and the output terminal. The first transistor and the second transistor are controlled such that after the first transistor and the second transistor are simultaneously turned on, the second transistor is turned off earlier than the first transistor.

9 Claims, 12 Drawing Sheets

DRIVE CIRCUIT

CROSS REFERENCE TO RELATED APPLICATION

The present application is based on and claims priority of Japanese Patent Application No. 2017-003702 filed on Jan. 12, 2017. The entire disclosure of the above-identified application, including the specification, drawings and claims is incorporated herein by reference in its entirety.

FIELD

The present disclosure relates to a drive circuit, and particularly to a drive circuit suitable for driving a pixel circuit.

BACKGROUND

A pixel circuit including light emitting devices, such as organic electro-luminescence (EL) devices receives from a drive circuit supply of a selection signal for writing a video signal in each pixel, and a power supply voltage signal for supplying a power supply voltage to be applied to a drive transistor in each pixel on a row-by-row basis. In buffer circuits included in an output stage of the drive circuit, in order to supply a pulse with no roundness (that is, "blunt corner") in (a rising edge and a falling edge of a signal waveform) at a transient time to each pixel, an approach such as using a transistor having a high current driving capability is devised (see, for instance, Patent Literature 1)

In the drive circuit in Patent Literature 1, the drain and source of a pair of transistors of a single channel are connected, the transistors are arranged between a positive-side power supply and a negative-side power supply, and the pair of transistors is driven by a drive signal with a signal level that changes complementarily. This protects against roundness at a transient time in an output signal.

CITATION LIST

Patent Literature

Patent Literature 1: Japanese Unexamined Patent Application Publication No. 2005-189680

SUMMARY

Technical Problem

However, in general, when a transistor continues to be on, as illustrated in FIG. 11, threshold voltage Vth shifts (shifts by shift amount ΔVth in FIG. 11) to a higher voltage, and the current driving capability of the transistor reduces. For this reason, when a buffer circuit is operated and a certain time elapses, roundness at a transient time occurs in an output signal supplied from the buffer circuit to a pixel circuit as illustrated in FIG. 12. For instance, when the edge of a power supply voltage signal supplied from the buffer circuit to a pixel is rounded, a period (a threshold correction operation period) for correcting a threshold voltage of the drive transistor in the pixel is decreased, and normal processing in the pixel is no longer ensured. As a consequence, an adverse effect such as a variation in pixel or lighting defect occurs in a display screen.

Thus, the present disclosure has been made in consideration of such a problem, and it is an object to provide a drive circuit that is capable of reducing decline in the current driving capability due to elapse of ON time of a transistor.

Solution to Problem

In order to achieve the above-mentioned object, a drive circuit according to a first aspect of the present disclosure includes a buffer circuit that includes a first transistor and a second transistor that are connected in parallel between a power supply and the output terminal. The first transistor and the second transistor are controlled such that after the first transistor and the second transistor are simultaneously turned on, the second transistor is turned off earlier than the first transistor.

Here, the second transistor may have a current driving capability greater than a current driving capability of the first transistor.

Also, in the drive circuit, a plurality of buffer circuits may be provided in stages, each of the plurality of buffer circuits being the buffer circuit, a plurality transfer circuits may be provided in stages in correspondence with the plurality of buffer circuits provided in stages, the first transistor included in Nth-stage buffer circuit, among the plurality of buffer circuits provided in stages, may be turned on based on one of rise and fall of a first control signal outputted from an Nth-stage transfer circuit among the plurality of transfer circuits provided in stages, and the second transistor included in the Nth-stage buffer circuit may be turned on based on the one of the rise and fall of the first control signal outputted from the Nth-stage transfer circuit, and may be turned off based on the other of the rise and fall of the first control signal.

Also, in the drive circuit, a plurality of buffer circuits may be provided in stages, each of the plurality of buffer circuits being the buffer circuit, a plurality transfer circuits may be provided in stages in correspondence with the plurality of buffer circuits provided in stages, the second transistor included in an Nth-stage buffer circuit, among the plurality of buffer circuits provided in stages, may be turned on and off based on a first control signal and a second control signal outputted from an Nth-stage transfer circuit and an (N+1)th and subsequent stage transfer circuit, respectively, among the plurality of buffer circuits provided in stages.

Also, the second transistor included in the Nth-stage buffer circuit may be turned on and off based on the first control signal outputted from the Nth-stage transfer circuit and the second control signal outputted from the (N+1)th-stage transfer circuit.

Also, the buffer circuit may further include an auxiliary transistor that maintains the second transistor at off when a voltage outputted from the output terminal is changed.

Also, the drive circuit may supply a drive signal to a pixel circuit including a plurality of pixels via the output terminal, and rise or fall of the drive signal may indicate timing of start or end of specific processing for at least one of the plurality of pixels.

A drive circuit that outputs from an output terminal a drive signal that assumes an ON potential and an OFF potential, the drive circuit including an ON potential output holding unit and an ON potential output unit that are connected in parallel between a first power supply and the output terminal, and place the first power supply and the output terminal in a conducting state or a non-conducting state. The ON potential output holding unit may output the ON potential to the output terminal and may hold the ON potential by maintaining the first power supply and the output terminal at a conducting state, and the ON potential output unit may output the ON potential to the output terminal by placing the first power supply and the output terminal in a conducting state for a certain period after the ON potential output holding unit outputs the ON potential to the output terminal.

The drive circuit further includes an OFF potential output holding unit and an OFF potential output unit that are connected in parallel between a second power supply and the output terminal, and place the second power supply and the output terminal in a conducting state or a non-conducting state. The OFF potential output holding unit may output the OFF potential to the output terminal and may hold the OFF potential by maintaining the second power supply and the output terminal at a conducting state, and the OFF potential output unit may output the OFF potential to the output terminal by placing the second power supply and the output terminal in a conducting state for a certain period after the OFF potential output holding unit outputs the OFF potential to the output terminal.

Advantageous Effects

The present disclosure provides a drive circuit that is capable of reducing decline in the current driving capability due to elapse of ON time of a transistor.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DESCRIPTION OF EMBODIMENTS

Hereinafter, an embodiment in the present disclosure will be described with reference to the drawings. It is to be noted that each of the embodiments described below illustrates a specific example of the present disclosure. The numerical values, shapes, materials, components, arrangement positions and topologies of the components, and timing of signals shown in the following embodiments are merely examples, and are not intended to limit the scope of the present disclosure. Those components in the following embodiments, which are not stated in the independent claim that defines the most generic concept are each described as an arbitrary component included in the embodiments. It is to be noted that the respective figures are not necessarily precise illustrations. In the respective figures, the same reference sign is given to substantially identical components, and a redundant description is omitted or simplified.

(Embodiment)

Figure 1:
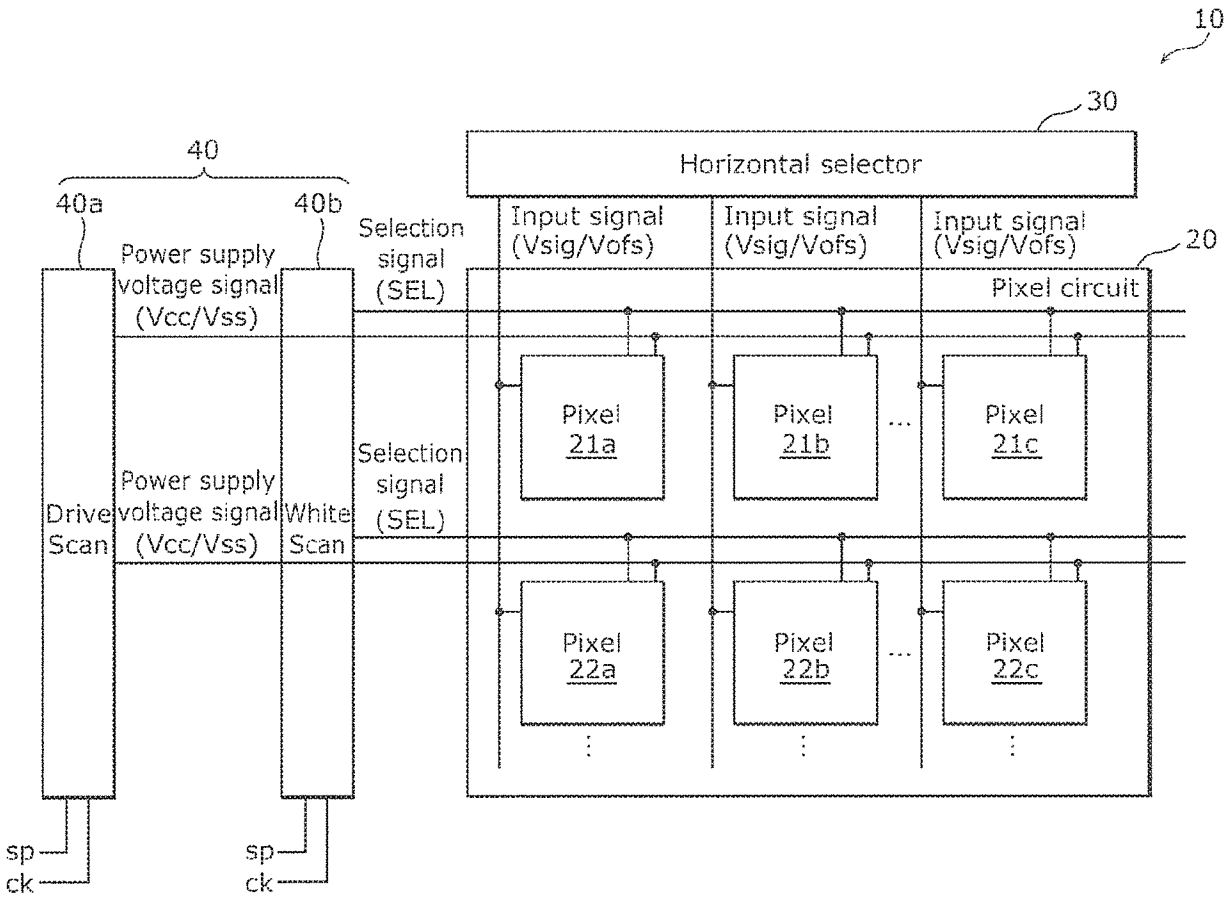
FIG. 1 is a block diagram illustrating a circuit of a display panel according to an embodiment.

FIG. 1 is a block diagram illustrating a circuit of a display panel 10 (here, an active-matrix organic EL circuit) according to an embodiment. The display panel 10 is an organic EL panel used as a display, such as a television screen or a tablet terminal, and includes a pixel circuit 20, a horizontal selector 30, and a drive circuit 40. It is to be noted that in this embodiment, for the transistors included in the display panel 10, amorphous silicon (aSi)—TFT or oxide TFT, for which a process is more simplified than low temperature polysilicon (LTPS)—thin film transistor (TFT), is used to reduce cost.

The pixel circuit 20 includes pixels 21*a* to 21*c* and 22*a* to 22*c* for light emission arranged in a two-dimensional pattern.

The horizontal selector 30 supplies input signals, such as a video signal Vsig and an offset signal Vofs to the pixels 21*a* to 22*c* included in the pixel circuit 20 on a column-by-column basis.

The drive circuit 40 is a vertical scanning circuit that supplies a drive signal (hereinafter an output signal from the drive circuit is also referred to as a "drive signal") to the pixel circuit 20, and includes a drive scan circuit 40*a* that supplies a power supply voltage signal (Vcc/Vss) which is one of the drive signals, and a write scan circuit 40*b* that supplies a selection signal Sel which is one of the drive signals. It is to be noted that each of the drive scan circuit 40*a* and the write scan circuit 40*b* is an example of a drive circuit, and has a structure of a shift register that operates with an input of clock signal ck and start pulse signal sp.

Figure 2:
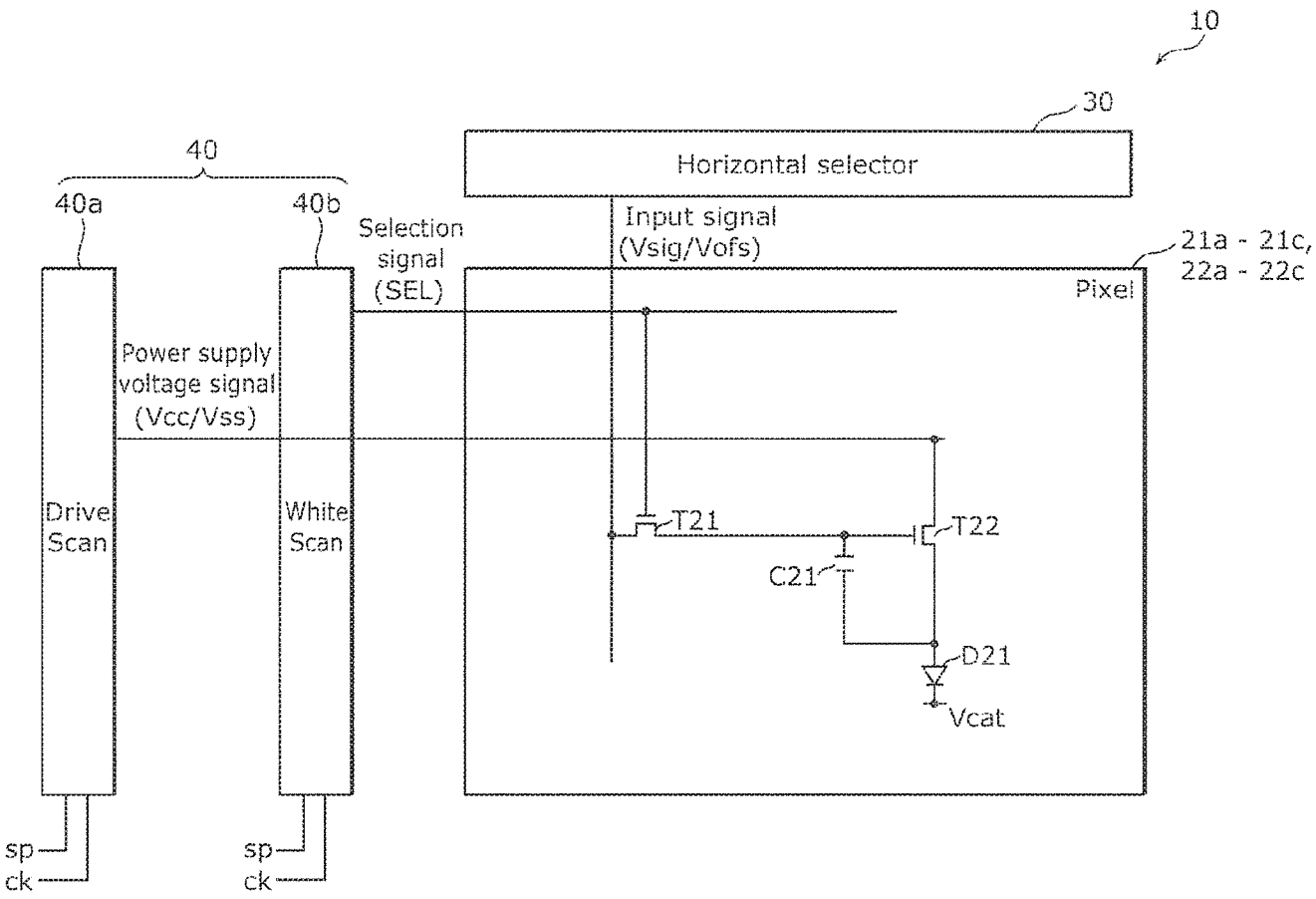
FIG. 2 is a diagram illustrating an example of a detailed circuit of each pixel illustrated in FIG. 1.

FIG. 2 is a diagram illustrating an example of a detailed circuit in the pixels 21*a* to 21*c* and 22*a* to 22*c* illustrated in FIG. 1. Here, the detailed circuit of one pixel is illustrated, Each of the pixels 21*a* to 21*c* and 22*a* to 22*c* includes a transistor T21, a transistor T22, a capacitor C21, and a light emitting device D21.

The transistor T21 is an NchMOS transistor for a switch that performs control to write an input signal (Vsig/Vofs) outputted from the horizontal selector 30 into the capacitor C21 based on the selection signal Sel which is from the write scan circuit 40*b* and inputted to the gate.

The capacitor C21 holds a threshold voltage of the transistor T22, or holds an input signal (Vsig/Vofs) written via the transistor T21.

The light emitting device D21 is an organic EL device connected between the source and the reference potential (cathodic potential Vcat) of the transistor T22.

The transistor T22 is an NchMOS transistor for drive such that a power supply voltage signal (Vcc/Vss) outputted from the drive scan circuit 40*a* is applied to the drain, and a current is passed between the drain and the source depending on the voltage between the gate and the source (that is, the voltage across both ends of the capacitor C21), thereby applying a current to the light emitting device D21.

Figure 3:
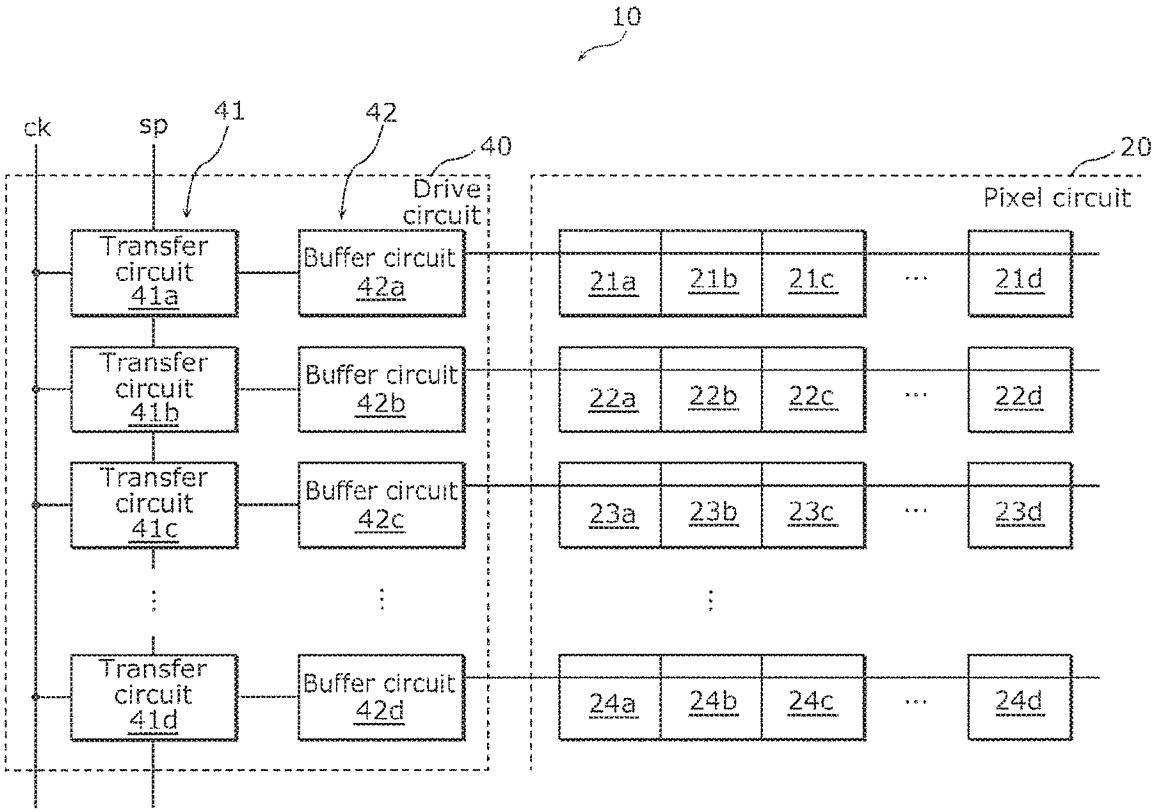
FIG. 3 is a block diagram illustrating a detailed configuration of the drive circuit illustrated in FIG. 1.

FIG. 3 is a block diagram illustrating a detailed configuration of the drive circuit 40 illustrated in FIG. 1. It is to be noted that the drive scan circuit 40*a* and the write scan circuit 40*b* included in the drive circuit 40 illustrated in FIG. 1 output drive signals at different timings, and have the function and configuration of the same circuit except that the timings are different. Thus, in the drive circuit 40 of FIG. 3, the configuration (in short, the configuration of a multi-stage circuit) of only one of the drive scan circuit 40*a* and the write scan circuit 40*b* illustrated in FIG. 1 is illustrated representatively.

As illustrated in FIG. 3, the drive circuit 40 includes multi-stage buffer circuits 42*a* to 42*d* (these are collectively called simply a buffer circuit 42), and multi-stage transfer circuits 41*a* to 41*d* (these are collectively called simply a transfer circuit 41) respectively corresponding (that is, connected) to the multi-stage buffer circuits 42*a* to 42*d*.

The transfer circuit 41 forms a shift register that receives input of start pulse signal sp, and operates in synchronization with clock signal ck, and the transfer circuits 41*a* to 41*d* in stages output pulse signals to respective corresponding buffer circuits 42*a* to 42*d* in stages.

The buffer circuit 42 includes the buffer circuits 42*a* to 42*d* in stages, and in this embodiment, each of the buffer circuits 42*a* to 42*d* in stages outputs drive signals (power supply voltage signal Vcc/Vss and selection signal Sel) to the pixel circuit 20 based on a pulse signal outputted from the transfer circuit in the same stage.

The pixel circuit 20 includes pixels 21*a* to 21*d*, 22*a* to 22*d*, 23*a* to 23*d*, and 24*a* to 24*d* for light emission arranged in a two-dimensional pattern. Each of the pixels 21*a* to 21*d*, 22*a* to 22*d*, 23*a* to 23*d*, and 24*a* to 24*d* on the same row is driven by a drive signal from corresponding one of the buffer circuits 42*a* to 42*d*, and emits light.

Figure 4A:
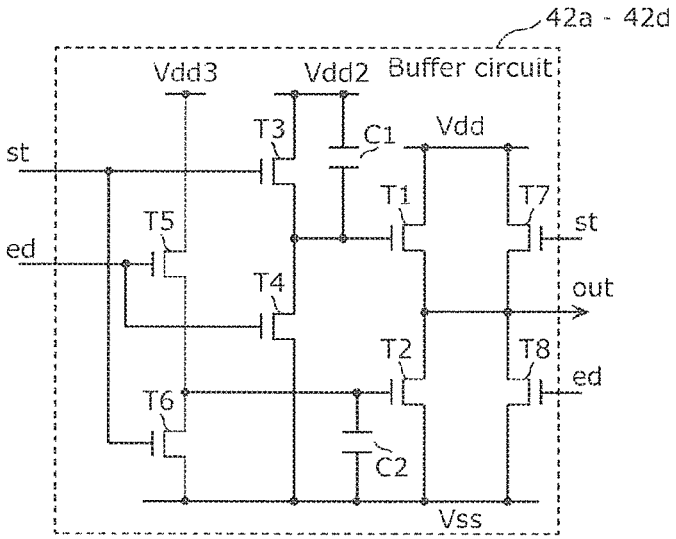
FIG. 4A is a detailed circuit diagram of each buffer circuit illustrated in FIG.

FIG. 4A is a detailed circuit diagram of the buffer circuits 42*a* to 42*d* illustrated in FIG. 3. It is to be noted that the buffer circuits 42*a* to 42*d* each have the same circuit configuration, thus the circuit diagram of one buffer circuit (hereinafter, representatively called the buffer circuit 42*a*) is illustrated in FIG. 4A.

The buffer circuit 42*a* is a circuit that outputs a drive signal from an output terminal out based on the pulse signals st and ed outputted from the transfer circuit 41*a* in the same stage, and includes eight transistors T1 to T8, and two capacitors C1 and C2. The eight transistors T1 to T8 are each an NchMOS transistor.

The transistor T1 is an example of the first transistor that is connected between the power supply (power supply potential Vdd) and the output terminal out, and supplies a power supply potential Vdd to the output terminal out.

The transistor T7 is an example of the second transistor connected between the power supply (power supply potential Vdd) and the output terminal out, and supplies the power supply potential Vdd to the output terminal out. In short, the transistors T1 and T7 are connected in parallel between the power supply (power supply potential Vdd) and the output terminal out, The transistor T7 has greater current driving capability than the transistor T1. For instance, the transistor T7 has a larger size (in other words, a larger gate width) than the transistor T1.

The transistor T2 is an example of the first transistor connected between the power supply (reference potential Vss) and the output terminal out, and supplies the power supply potential Vss to the output terminal out.

The transistor T8 is an example of the second transistor connected between the power supply (reference potential Vss) and the output terminal out, and supplies the reference potential Vss to the output terminal out. In short, the transistors T2 and T8 are connected in parallel between the power supply (reference potential Vss) and the output terminal out. The transistor T8 has greater current driving capability than the transistor T2. For instance, the transistor T8 has a larger size (in other words, a larger gate width) than the transistor T2.

The transistor T3 is connected between the power supply (power supply potential Vdd2) and the gate of the transistor T1, and supplies the power supply potential Vdd2 to the gate of the transistor T1 based on the pulse signal st outputted from the transfer circuit 41*a* in the same stage.

The transistor T4 is connected between the gate of the transistor T1 and the power supply (reference potential Vss), and supplies the reference potential Vss to the gate of the transistor T1 based on the pulse signal ed outputted from the transfer circuit 41*a* in the same stage.

The transistor T5 is connected between the power supply (power supply potential Vdd3) and the gate of the transistor T2, and supplies the power supply potential Vdd3 to the gate of the transistor T2 based on the pulse signal ed outputted from the transfer circuit 41*a* in the same stage.

The transistor T6 is connected between the gate of the transistor T2 and the power supply (reference potential Vss), and supplies the reference potential Vss to the gate of the transistor T2 based on the pulse signal st outputted from the transfer circuit 41*a* in the same stage.

The capacitor C1 is connected between the power supply (power supply potential Vdd2) and the gate of the transistor T1, and is used to hold the potential of the gate of the transistor T1.

The capacitor C2 is connected between the gate of the transistor T2 and the power supply (reference potential Vss), and is used to hold the potential of the gate of the transistor T2.

Figure 4B:
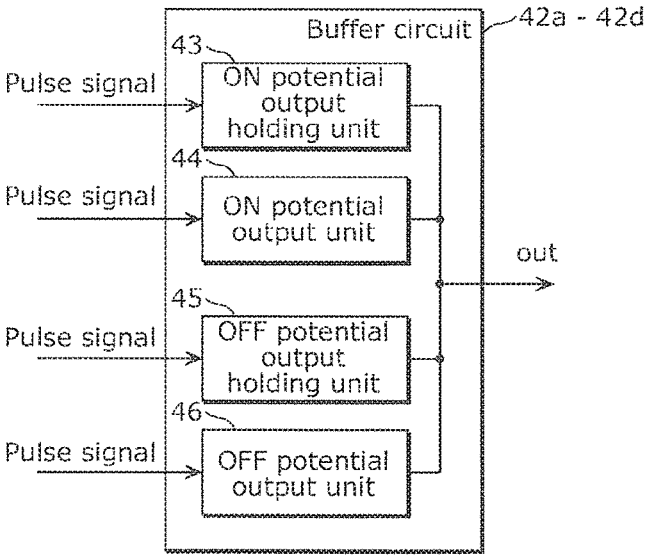
FIG. 4B is a block diagram functionally illustrating the buffer circuit illustrated in FIG. 4A.

FIG. 4B is a block diagram functionally illustrating the buffer circuits 42*a* to 42*d* illustrated in FIG. 4A. Each of the buffer circuits 42*a* to 42*d* is a circuit that outputs a drive signal, indicating ON potential (Vdd) or OFF potential (Vss), from the output terminal out, and includes an ON potential output holding unit 43, an ON potential output unit 44, an OFF potential output holding unit 45, and an OFF potential output unit 46. The ON potential output holding unit 43 and the ON potential output unit 44 are circuits that are connected in parallel between the first power supply (power supply potential Vdd) and the output terminal out, and place the first power supply (power supply potential Vdd) and the output terminal out in a conducting state or a non-conducting state.

The ON potential output holding unit 43 corresponds to the circuit comprised of the transistors T1, T3, T4, and the capacitor C1 in FIG. 4A, and outputs ON potential to the output terminal out and holds ON potential by maintaining the first power supply (power supply potential Vdd) and the output terminal out at a conducting state based on the pulse signals st and ed outputted from the transfer circuit 41*a* in the same stage.

The ON potential output unit 44 corresponds to the transistor T7 in FIG. 4A, and outputs ON potential to the output terminal out by placing the first power supply (power supply potential Vdd) and the output terminal out in a conducting state based on the pulse signal st outputted from the transfer circuit 41*a* in the same stage for a certain period after the ON potential output holding unit 43 outputs ON potential to the output terminal out.

The OFF potential output holding unit 45 and the OFF potential output unit 46 are circuits that are connected in parallel between the second power supply (reference potential Vss) and the output terminal out, and place the second power supply (reference potential Vss) and the output terminal out in a conducting state or a non-conducting state.

The OFF potential output holding unit 45 corresponds to the circuit comprised of the transistors T2, T5, T6, and the capacitor C2 in FIG. 4A, and outputs OFF potential to the output terminal out and holds OFF potential by maintaining the first power supply (power supply potential Vdd) and the output terminal out in a conducting state based on the pulse signals st and ed outputted from the transfer circuit 41*a* in the same stage.

The OFF potential output unit 46 corresponds to the transistor T8 in FIG. 4A, and outputs OFF potential to the output terminal out by placing the second power supply (reference potential Vss) and the output terminal out in a conducting state based on the pulse signal ed outputted from the transfer circuit 41*a* in the same stage for a certain period after the OFF potential output holding unit 45 outputs OFF potential to the output terminal Out.

Next, the operation of the drive circuit 40 of the display panel 10 according to this embodiment in the aforementioned configuration will be described.

Figure 5:
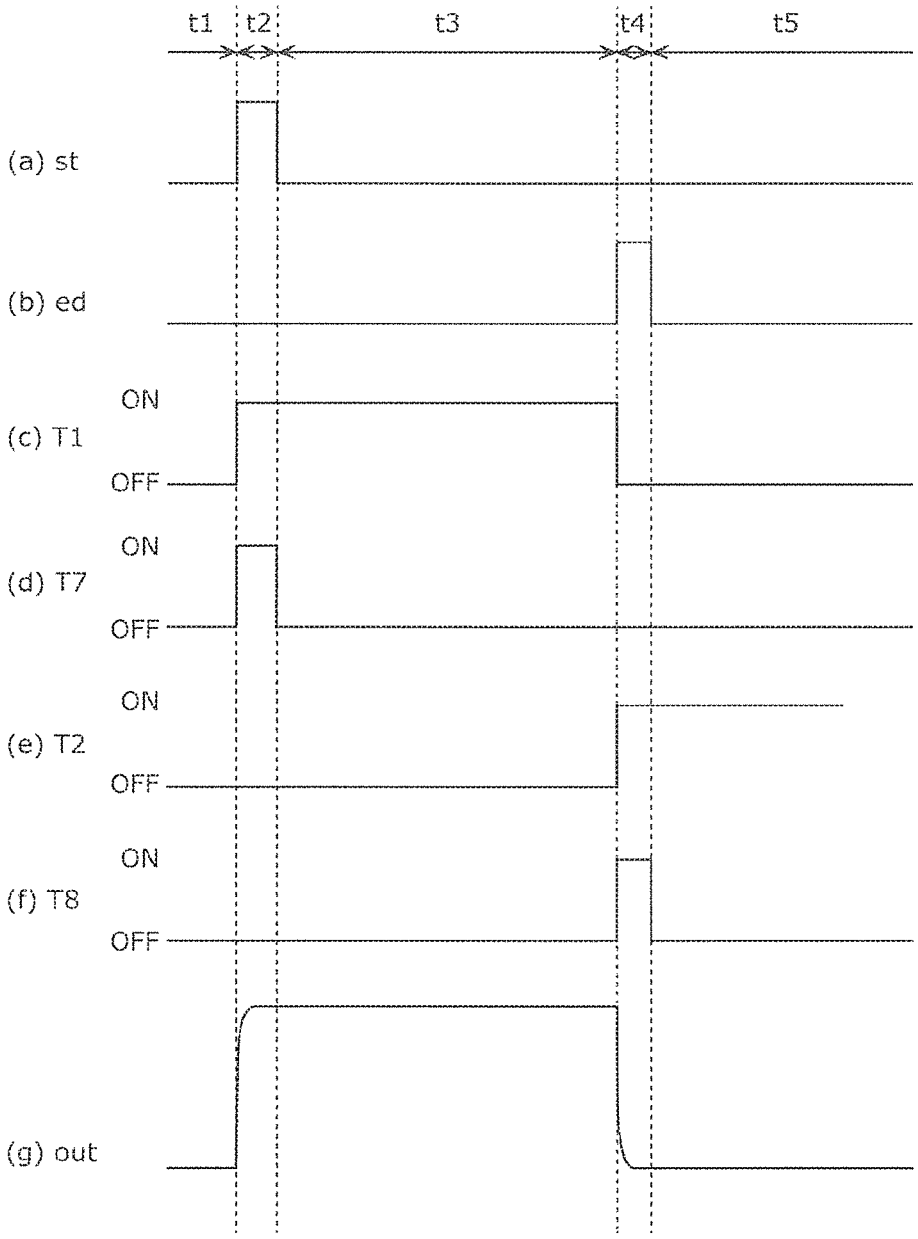
FIG. 5 is a timing chart illustrating the operation of a buffer circuit included in a drive circuit according to the embodiment.

FIG. 5 is a timing chart illustrating the operation of the buffer circuits 42*a* to 42*d* included in the drive circuit 40 according to this embodiment. FIGS. 5A to 5G illustrate the pulse signal st outputted from the transfer circuit in the same stage, the pulse signal ed outputted from the transfer circuit in the same stage, ON/OFF state of the transistor T1, ON/OFF state of the transistor T7, ON/OFF state of the transistor T2, ON/OFF state of the transistor T8, and a drive signal outputted from the output terminal out, respectively. It is to be noted that High of each signal corresponds to the power supply potential (Vdd/Vdd2/Vdd3), and Low corresponds to the reference potential Vss.

FIGS. 6A to 6E are diagrams illustrating the respective operating states (specifically, ON/OFF state of each transistor) of the buffer circuits 42*a* to 42*d* in periods t1 to t5 in FIG. 5.

(1) Period t1

Figure 6A:
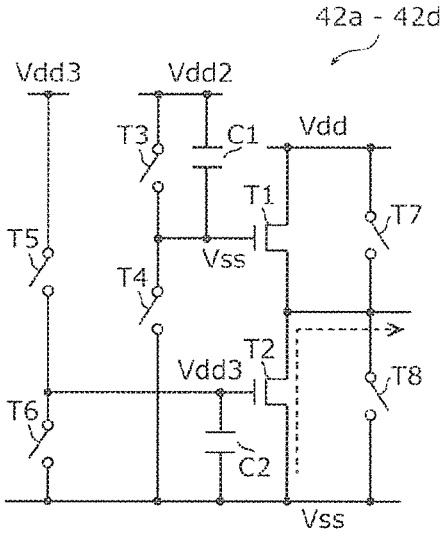
FIG. 6A is a circuit diagram illustrating an operating state of the buffer circuit in period t1 in FIG. 5.

Both the pulse signals st and ed are Low in period t1, each of the transistors T3 to T6, T7, and T8 are each set to OFF as illustrated in FIG. 6A. The gate is maintained at immediately previous state Low by the capacitor C1 (see FIG. 6D, FIG. 6E), thus the transistor T1 is set to OFF. The gate is maintained at immediately previous state High by the capacitor C2 (see FIG. 6D, FIG. 6E), thus the transistor T2 is set to ON.

Thus, in the period t1, out of four transistor T1, T2, T7, and T8 that determine the state of the output terminal out, only the transistor T2 is set to ON, and therefore the output terminal out is set to Low.

(2) Period t2

Figure 6B:
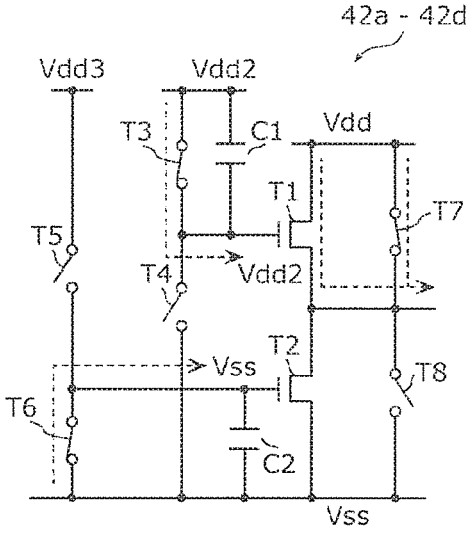
FIG. 6B is a circuit diagram illustrating an operating state of the buffer circuit in period t2 in FIG. 5.

In period t2, the pulse signal st is changed to High, thus as illustrated in FIG. 6B, the transistors T3, T6, and T7, to which the pulse signal st is inputted, are set to ON. As a consequence, the transistor T7 is turned on, thus supplies the power supply potential Vdd to the output terminal out. Also, the power supply potential Vdd2 is applied to the gate of the transistor T1 via the transistor T3, thus the transistor T1 supplies the power supply potential Vdd to the output terminal out. Thus, in the period t2, out of four transistor T1, T2, T7, and T8 that determine the state of the output terminal out, the transistors T1 and T7 are set to ON, and therefore the output terminal out is set to High.

Like this, in the period t2, out of four transistor T1, T2, T7, and T8 that determine the state of the output terminal out, two transistors T1 and T7 are set to ON, and therefore, in contrast to the case where only the transistor T1 is set to ON, a larger current driving capability is exhibited. As a consequence, decline in the current driving capability due to elapse of ON time of transistors is reduced, and a drive signal having a waveform with a sharp rising edge and reduced roundness at a transient time is outputted from the drive circuit 40.

(3) Period t3

Figure 6C:
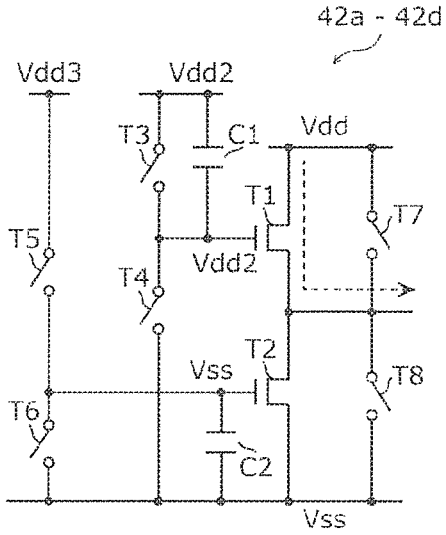
FIG. 6C is a circuit diagram illustrating an operating state of the buffer circuit in period t3 in FIG. 5.

In period t3, the pulse signal st is changed to Low, thus as illustrated in FIG. 6C, the transistors T3 to T6, T7, and T8, to which the pulse signal st is inputted, are each set to OFF, However, in the capacitor C1, the state (High) in the immediately previous period t2 is held, and the power supply potential Vdd2 is applied to the gate of the transistor T1, and thus the transistor T1 is maintained at ON. Also, in the capacitor C2, the state (Low) in the immediately previous period t2 is held, the reference potential Vss is applied to the gate of the transistor T2, and thus the transistor T2 is maintained at OFF. Thus, in the period t3, out of four transistor T1, T2, T7, and T8 that determine the state of the output terminal out, only the transistor T1 is set to ON, and the output terminal out is maintained at High.

Like this, although the output terminal out is maintained at High in the period t3, the transistor T7, which has been set to ON in the immediately previous period t2, is set to OFF, and thus extension of ON time of transistor T7 is reduced, and decline in the current driving capability (eventually, the current driving capability of the drive circuit 40) of the transistor T7 due to elapse of ON time is reduced.

(4) Period t4

Figure 6D:
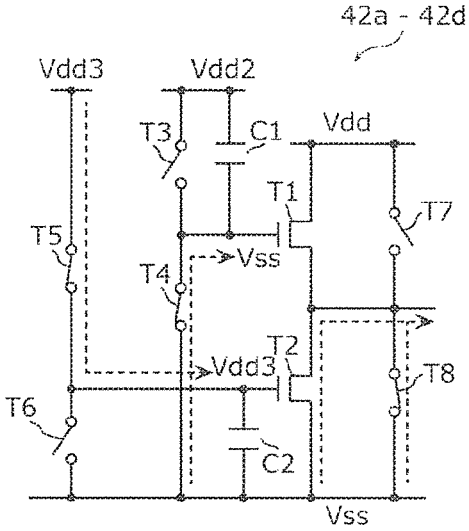
FIG. 6D is a circuit diagram illustrating an operating state of the buffer circuit in period t4 in FIG. 5.

In period t4, the pulse signal ed is changed to High, thus as illustrated in FIG. 6D, the transistors T4, T5, and T8, to which the pulse signal ed is inputted, are set to ON. As a consequence, the reference potential Vss is applied to the gate of the transistor T1 via the transistor T4, and the transistor T1 is set to OFF. Also, the transistor T8 is turned on, thus supplies the reference potential Vss to the output terminal out. Also, the power supply potential Vdd3 is applied to the gate of the transistor T2 via the transistor T5, and the transistor T2 is turned on, thus supplies the reference potential Vss to the output terminal out. Thus, in the period t4, out of four transistor T1, T2, T7, and T8 that determine the state of the output terminal out, the transistors T2 and T8 are set to ON, and the output terminal out is changed to Low.

Thus, in the period t4, out of four transistor T1, T2, T7, and T8 that determine the state of the output terminal out, two transistors T2 and T8 are set to ON, and therefore, in contrast to the case where only the transistor T2 is set to ON, a larger current driving capability is exhibited. As a consequence, decline in the current driving capability due to elapse of ON time of transistors is reduced, and a drive signal having a waveform with a sharp falling edge and reduced roundness at a transient time is outputted from the drive circuit 40.

(5) Period t5

Figure 6E:
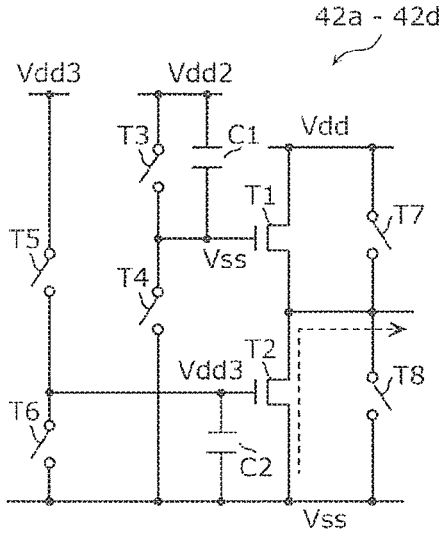
FIG. 6E is a circuit diagram illustrating an operating state of the buffer circuit in period t5 in FIG. 5.

In period t5, the pulse signal ed is changed to Low, thus as illustrated in FIG. 6E, the transistors T4, T5, and T8, to which the pulse signal ed is inputted, are each set to OFF. However, in the capacitor C1, the state (Low) in the immediately previous period t4 is held, and the reference potential Vss is applied to the gate of the transistor T1, and thus the transistor T1 is maintained at ON. Also, in the capacitor C2, the state (High) in the immediately previous period t4 is held, the power supply potential Vdd3 is applied to the gate of the transistor T2, and thus the transistor T2 is maintained at ON. Thus, in the period t5, out of four transistor T1, T2, T7, and T8 that determine the state of the output terminal out, only the transistor T2 is set to ON, and the output terminal out is maintained at Low.

Like this, although the output terminal out is maintained at low in the period t5, the transistor T8, which has been set to ON in the immediately previous period t4, is set to OFF, and thus extension of ON time of transistor T8 is reduced, and decline in the current driving capability (eventually, the current driving capability of the drive circuit 40) of the transistor T8 due to elapse of ON time is reduced.

As described above, in the buffer circuits 42*a* to 42*d* according to this embodiment, when the pulse signal st is changed from Low to High, the transistors T1 and T7 are turned on, and when the pulse signal st is changed from High to Low, the transistor T7 is turned off. Similarly, when the pulse signal ed is changed from Low to High, the transistors T2 and T8 are turned on, and when the pulse signal ed is changed from High to Low, the transistor T8 is turned off. Consequently, when the output terminal out is changed from Low to High or from High to Low, pulses (drive signals) are outputted by the transistors T1 and T7, and the transistors T2 and T8 which are connected in parallel to the power supply, and subsequently, the output potential is held by the transistors T1 and T2. In other words, it can be said that the current driving capability of the transistors and T2 in switching between the levels of the output terminal out is quasi increased by transistors T7 and T8.

Also, the pulse signals st and ed are inputted to the gate of the transistors T7 and T8, respectively, and the ON period is the width of the pulse signals st and ed, thus is shorter than the ON period of the transistors T1 and T2. Therefore, the shift amount ΔVth of the threshold voltage of the transistors T7 and T8, is smaller than the shift amount of the transistors T1 and T2. Here, the current driving capability of the transistors T7 and T8 is higher than the current driving capability of the transistors T1 and T2, thus the current driving capability of the buffer circuits 42*a* to 42*d* at change of the drive signal is not significantly reduced. Consequently, it is possible to reduce occurrence of poor image caused by roundness of drive signals.

As described above, the drive circuit 40 according to this embodiment is a drive circuit that has the output terminal out, and includes the buffer circuit 42 including the first transistor (T1 or T2) and the second transistor (T7 or T8) connected in parallel between the power supply (power supply potential Vdd or Vss) and the output terminals out, and the drive circuit 40 is controlled so that the first transistor (T1 or T2) and the second transistor (T7 or T8) are turned on simultaneously, then the second transistor (T7 or T8) is turned off earlier than the first transistor (T1 or T2).

Thus, the first transistor (T1 or T2) and the second transistor (T7 or T8) are simultaneously turned on at a transient time, and the current driving capability of the buffer circuit 42 is increased, thus in contrast to the drive circuit in related art, in which only one transistor is turned on, decline in the current driving capability due to elapse of ON time of transistors is reduced. Consequently, a signal having a waveform with a sharp edge and reduced roundness at a transient time is outputted from the drive circuit 40, and when the signal is supplied to the pixel circuit 20, occurrence of an adverse effect, such as a variation in pixel or lighting defect due to a decreased threshold correction operation period is reduced.

Furthermore, the first transistor (T1 or T2) and the second transistor (T7 or T8) are turned on simultaneously, then the second transistor (T7 or T8) is turned off earlier than the first transistor (T1 or T2), thus in the second transistor (T7 or T8) which is added to the drive circuit in related art, extension of ON time as in the first transistor (T1 or T2) is reduced, and decline in the current driving capability due to elapse of ON time is reduced.

In addition, the second transistor (T7 or T8) has a greater current driving capability than the first transistor (T1 or T2).

Thus, the second transistor (T7 or T8) which is turned on only at change of the state of the output signal has a greater current driving capability than the first transistor that maintains ON (T1 or T2), thus significant decline in the current driving capability of the buffer circuit 42 at change of the output signal is reduced. Consequently, the output signal from the drive circuit 40 has a waveform with a sharp edge and reduced roundness at a transient time.

The drive circuit 40 includes the multi-stage buffer circuits 42*a* to 42*d*, and multi-stage transfer circuits 41*a* to 41*d* respectively corresponding to the multi-stage buffer circuits 42*a* to 42*d*, in which the first transistor (T1 or T2) included in Nth stage buffer circuit is turned on based on one of rise and fall of the first control signal (pulse signal st or ed) outputted from Nth stage transfer circuit, and the second transistor (T7 or T8) included in the Nth stage buffer circuit is turned on based on one of rise and fall of the first control signal and is turned off based on the other of rise and fall of the first control signal (pulse signal st or ed) outputted from the Nth stage transfer circuit.

Therefore, each of the first transistor (T1 or T2) and the second transistor (T7 or T8) included in the Nth stage buffer circuit is turned on and/or turned off based on the first control signal (pulse signal st or ed) outputted from the transfer circuit in the same stage, and thus the drive circuit 40 has a relatively simple circuit configuration, and when used for the pixel circuit, a narrow frame is achieved.

Also, the drive circuit 40 supplies a drive signal to the pixel circuit 20 including multiple pixels via the output terminal out, and rise or fall of the drive signal indicates the timing of the start or end of specific processing (for instance, threshold correction) performed on at least one of the multiple pixels.

Consequently, a drive signal, which is outputted from the drive circuit 40 and has a waveform with a sharp edge and reduced roundness at a transient time, is supplied to the pixel circuit 20, thus occurrence of poor image caused by roundness at a transient time is reduced.

The drive circuit 40 according to this embodiment is a drive circuit that outputs a drive signal indicating ON potential or OFF potential from the output terminal out, and includes the ON potential output holding unit 43 and the ON potential output unit 44 that are connected in parallel between the first power supply (power supply potential Vdd) and the output terminal out, and place the first power supply (power supply potential Vdd) and the output terminal out in a conducting state or a non-conducting state. The ON potential output holding unit 43 outputs ON potential to the output terminal out and holds ON potential by maintaining the first power supply (power supply potential Vdd) and the output terminal out at a conducting state, and the ON potential output unit 44 outputs ON potential to the output terminal out by placing the first power supply (power supply potential Vdd) and the output terminal out in a conducting state for a certain period after the ON potential output holding unit 43 outputs ON potential to the output terminal out.

Thus, the ON potential output holding unit 43 and the ON potential output unit 44 are simultaneously turned on to output ON potential, and the current driving capability of the drive circuit 40 is increased, thus in contrast to the drive circuit in related art, in which only one ON potential output holding unit 43 outputs ON potential, decline in the current driving capability due to elapse of ON time of transistors is reduced. Consequently, a signal having a waveform with a sharp edge and reduced roundness at a transient time is outputted from the drive circuit 40, and when the signal is supplied to the pixel circuit, occurrence of an adverse effect, such as a variation in pixel or lighting defect due to a decreased threshold correction operation period is reduced.

Furthermore, the ON potential output unit 44 outputs ON potential to the output terminal out by turning ON for a certain period after the ON potential output holding unit 43 outputs ON potential to the output terminal out, thus the ON potential output unit 44 which is added to the drive circuit in related art, extension of ON time as in the ON potential output holding unit 43 is reduced, and decline in the current driving capability due to elapse of ON time of transistors is reduced.

The drive circuit 40 includes the OFF potential output holding unit 45 and the OFF potential output unit 46 that are connected in parallel between the second power supply (reference potential Vss) and the output terminal out, and place the second power supply (reference potential Vss) and the output terminal out in a conducting state or a non-conducting state. The OFF potential output holding unit 45 outputs OFF potential to the output terminal out and holds OFF potential by maintaining the second power supply (reference potential Vss) and the output terminal out at a conducting state, and the OFF potential output unit 46 outputs OFF potential to the output terminal out by placing the second power supply (reference potential Vss) and the output terminal out in a conducting state for a certain period after the OFF potential output holding unit 45 outputs OFF potential to the output terminal out.

Thus, the OFF potential output holding unit 45 and the OFF potential output unit 46 are simultaneously turned on to output OFF potential, and the current driving capability of the drive circuit 40 is increased, thus in contrast to the drive circuit in related art, in which only one OFF potential output holding unit 45 outputs OFF potential, decline in the current driving capability due to elapse of ON time of transistors is reduced. Consequently, a signal having a waveform with a sharp edge and reduced roundness at a transient time is outputted from the drive circuit 40, and when the signal is supplied to the pixel circuit, occurrence of an adverse effect, such as a variation in pixel or lighting defect due to a decreased threshold correction operation period is reduced.

Furthermore, the OFF potential output unit 46 outputs OFF potential to the output terminal out by turning ON for a certain period after the OFF potential output holding unit 45 outputs OFF potential to the output terminal out, thus the OFF potential output unit 46 which is added to the drive circuit in related art, extension of ON time as in the OFF potential output holding unit 45 is reduced, and decline in the current driving capability due to elapse of ON time of transistors is reduced.

(Variation 1)

Next, the drive circuit according to Variation 1 of the embodiment will be described. The drive circuit according to this variation has the same basic configuration (the transfer circuit and the buffer circuit) as the configuration of the drive circuit 40 according to the embodiment, and the detailed configuration of the buffer circuit is different from the configuration of the embodiment.

Figure 7:
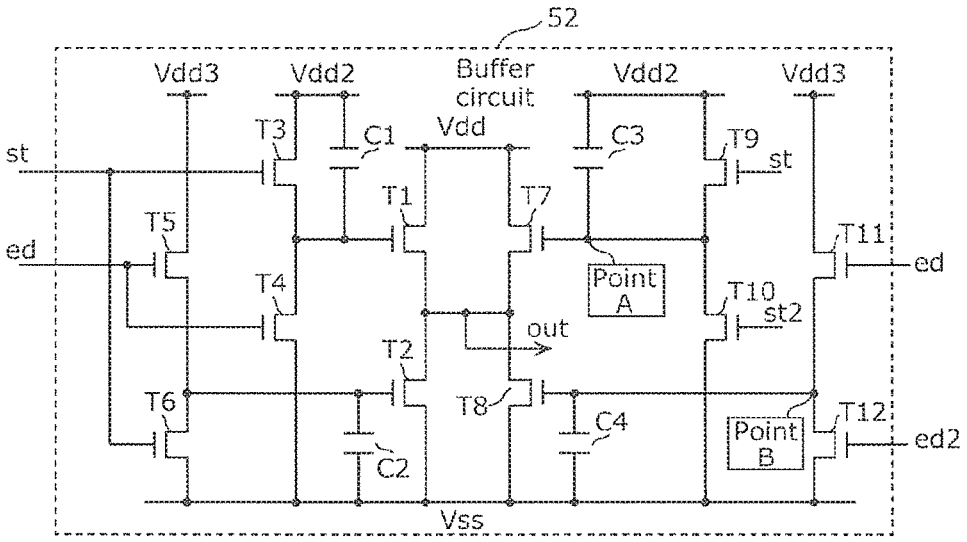
FIG. 7 is a circuit diagram of a buffer circuit according to Variation 1 of the embodiment.

FIG. 7 is a circuit diagram of a buffer circuit 52 according to Variation 1 of the embodiment. The buffer circuit 52 has a configuration in which four transistors T9 to T12 and two capacitors C3 and C4 are added to the buffer circuits 42*a* to 42*d* according to the embodiment illustrated in FIG. 4A.

The transistor T9 is connected between the power supply (power supply potential Vdd2) and the gate (point A) of the transistor T7, and supplies the power supply potential Vdd2 to the gate of the transistor T7 based on the pulse signal st outputted from the transfer circuit in the same stage.

The transistor T10 is connected between the gate of the transistor T7 and the power supply (reference potential Vss), and supplies the reference potential Vss to the gate of the transistor T7 based on the pulse signal st2 outputted from the transfer circuit in the subsequent stages. It is to be noted that the pulse signal st2 a pulse signal outputted from the transfer circuit in a stage later (for instance, the subsequent stage) than the buffer circuit 52, and has a pulse waveform at a timing later than the pulse signal st.

The transistor T11 is connected between the power supply (power supply potential Vdd3) and the gate (B point) of transistor T8, and supplies the power supply potential Vdd3 to the gate of the transistor T8 based on the pulse signal ed outputted from the transfer circuit in the same stage.

The transistor T12 is connected between the gate of the transistor T8 and the power supply (reference potential Vss), and supplies the reference potential Vss to the gate of the transistor T8 based on the pulse signal ed2 outputted from the transfer circuit in the subsequent stages. It is to be noted that the pulse signal ed2 a pulse signal outputted from the transfer circuit in a stage later (for instance, the subsequent stage) than the buffer circuit 52, and has a pulse waveform at a timing later than the pulse signal ed.

The capacitor C3 is connected between the power supply (power supply potential Vdd2) and the gate of the transistor T7, and is used to hold the potential of the gate of the transistor T7.

The capacitor C4 is connected between the gate of the transistor T8 and the power supply (reference potential Vss), and is used to hold the potential of the gate of the transistor T8.

Unlike the above-described embodiment, this variation adopts a configuration in which pulse signals (such as st, and ed) from the transfer circuits are not directly inputted to, but the output signals driven by the transistors T9 to T12 are inputted to the gates of the transistors T7 and T8. This is because the transistors T7 and T8 are designed to have a large size (in other words, a large gate width) so as to have a large current driving capability, and thus the input capacitance (in other words, the parasitic capacitance of the gate) is large. Thus, if pulse signals are directly inputted to the gates of the transistors T7 and T8, the waveform of the pulse signals is rounded, and the roundness may cause ON timing the transistors T7 and T8 to be varied with stages, and abnormality may occur in the output waveform. Thus, pulse signals are inputted to the transistors T9 to T12 which can be reduced in size, and the output signals driven by the transistors T9 to T12 are inputted to the gates of the transistors T7 and T8. Consequently, roundness of the waveform of the pulse signals, which may be caused by direct input of pulse signals to the gates of the transistors T7 and T8, is reduced.

It is to be noted that the buffer circuit 52 illustrated in FIG. 7 also has functionally the same configuration as the functional block illustrated in FIG. 46 in the above-described embodiment. In this variation, the ON potential output unit 44 is equivalent to the circuit obtained by adding the transistors T9 and T10 and the capacitor C3 to the transistor T7. Also, the OFF potential output unit 46 is equivalent to the circuit obtained by adding the transistors T11 and T12 and the capacitor C4 to the transistor T8.

Figure 8:
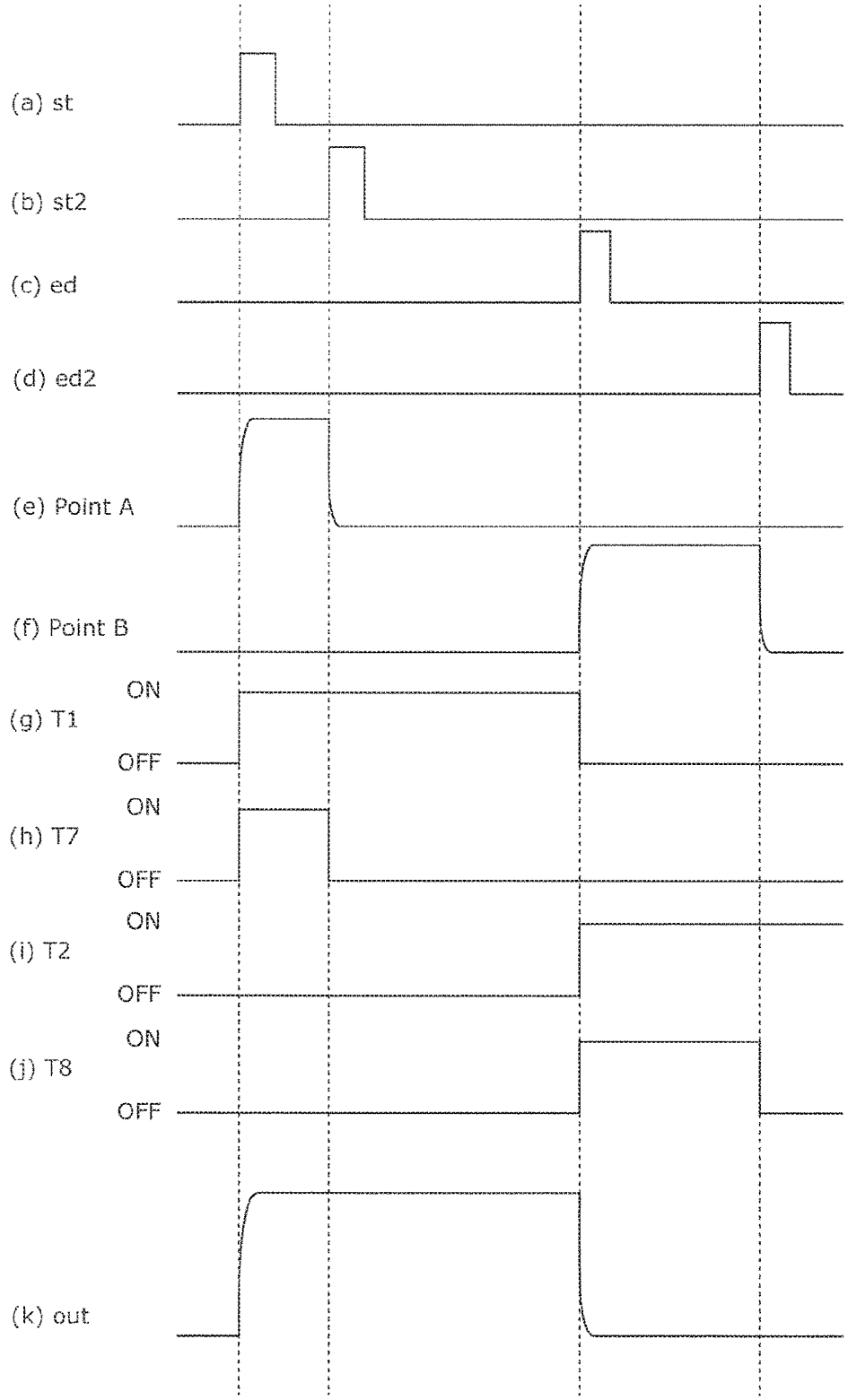
FIG. 8 is a timing chart illustrating the operation of the buffer circuit according to Variation 1 of the embodiment.

FIG. 8 is a timing chart illustrating the operation of the buffer circuit 52 according to this variation. (a) to (k) of FIG. 8 indicate the pulse signal st outputted from the transfer circuit in the same stage, the pulse signal st2 outputted from the subsequent stage transfer circuit, the pulse signal ed outputted from the transfer circuit in the same stage, the pulse signal ed2 outputted from the subsequent stage transfer circuit, the potential of point A in FIG. 7, the potential of point 6 in FIG. 7, ON/OFF state of the transistor T1, ON/OFF state of the transistor T7, ON/OFF state of the transistor T2, ON/OFF state of the transistor T8, and the drive signal outputted from the output terminal out, respectively.

As is seen from comparison with the timing chart of FIG. 5, the point of difference from the operation of the buffer circuits 42*a* to 42*d* according to the above-described embodiment is the operation of the transistors T7 and T8.

When attention is focused on the gate (point A of FIG. 7) of the transistor T7, the transistor T9 is turned on based on the pulse signal st, and thus point A is changed to High (power supply potential Vdd2) to turn ON the transistor T7. Subsequently, even when the transistor T9 is turned off, point A is maintained at High by the capacitor C3, and subsequently, the transistor T10 is turned on based on the pulse signal st2, thereby changing point A to Low (reference potential Vss) to turn OFF the transistor T7.

In contrast, when attention is focused on the gate (point B of FIG. 7) of the transistor T8, the transistor T11 is turned on based on the pulse signal ed, and thus point B is changed to High (power supply potential Vdd3) to turn ON the transistor T8. Subsequently, even when the transistor T11 is turned off, point B is maintained at High by the capacitor C4, and subsequently, the transistor T12 is turned on based on the pulse signal ed2, thereby changing point B to Low (reference potential Vss) to turn OFF the transistor T8.

As described above, similarly to the above-described embodiment, the drive circuit according to this variation includes the buffer circuit 52 including the first transistor (T1 or T2) and the second transistor (T7 or T8) that are connected in parallel between the power supply (power supply potential Vdd or Vss) and the output terminal out, and the first transistor (T1 or T2) and the second transistor (T7 or T8) are simultaneously turned on, then the second transistor (T7 or T8) is controlled to be turned off earlier than the first transistor (T1 or T2).

Thus, the first transistor (T1 or T2) and the second transistor (T7 or T8) are simultaneously turned on at a transient time, and the current driving capability of the buffer circuit 52 is increased, thus in contrast to the drive circuit in related art, in which only one transistor is turned on, decline in the current driving capability due to elapse of ON time of transistors is reduced. Consequently, a signal having a waveform with a sharp edge and reduced roundness at a transient time is outputted from the drive circuit 20, and when the signal is supplied to the pixel circuit, occurrence of an adverse effect, such as a variation in pixel or lighting defect due to a decreased threshold correction operation period is reduced.

Unlike the above-described embodiment, in this variation, pulse signals are inputted from the transfer circuits to the transistors T9 to T12 which can be reduced in size, and the output signals driven by the transistors T9 to T12 are inputted to the gates of the transistors T7 and T8.

Consequently, roundness of the waveform of the pulse signals, which may be caused by direct input of pulse signals to the gates of the transistors T7 and T8, is reduced.

Also, the second transistor (T7 or T8) included in the Nth stage buffer circuit 52 is turned on and off based on the first control signal (pulse signal st or ed) outputted from the Nth stage transfer circuit, and the second control signal (pulse signal st2 or ed2) outputted from the (N+1)th or later stage transfer circuit.

Thus, the second transistor (T7 or T8) included in the Nth stage buffer circuit 52 is turned on and/or turned off based on the first control signal outputted from the transfer circuit in the same stage and the second control signal outputted from the transfer circuit in the subsequent stages, and therefore, ON period of the second transistor (T7 or T8) can be adjusted in an appropriate period by selecting an appropriate one of the transfer circuits in the subsequent stages as the transfer circuit that outputs the second control signal.

Also, the second transistor (T7 or T8) included in the Nth stage buffer circuit 52 is turned on and off based on the first control signal (pulse signal st or ed) outputted from the Nth stage transfer circuit, and the second control signal (pulse signal st2 or ed2) outputted from the (N+1)th stage transfer circuit.

Thus, the second transistor (T7 or T8) included in the Nth stage buffer circuit 52 is turned on and/or turned off based on the first control signal outputted from the transfer circuit in the same stage and the second control signal outputted from the transfer circuit in the subsequent stage, and thus, as compared with the case where the transfer circuit in the previous stage rather than the subsequent stage is used as the transfer circuit that outputs the second control signal, a transfer circuit disposed at a closer position is used, and consequently, the complexity of routing of control signals in the drive circuit is reduced.

(Variation 2)

Next, a drive circuit according to Variation 2 of the embodiment will be described. The drive circuit according to this variation has the same basic configuration (the transfer circuit and the buffer circuit) as the configuration of the drive circuit 40 according to the embodiment, and the detailed configuration of the buffer circuit is different from the configuration of the embodiment.

Figure 9:
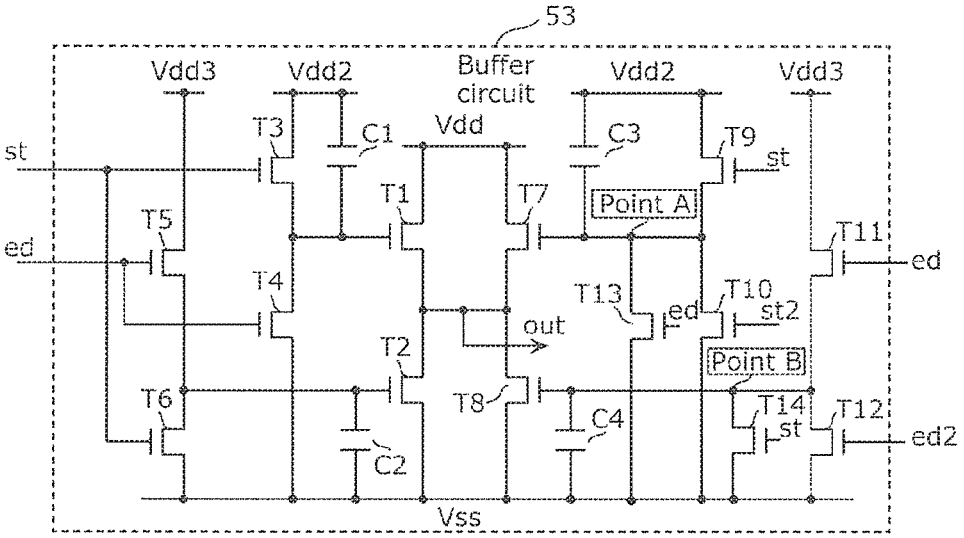
FIG. 9 is a circuit diagram of a buffer circuit according to Variation 2 of the embodiment.

FIG. 9 is a circuit diagram of a buffer circuit 53 according to Variation 2 of the embodiment. The buffer circuit 53 has a configuration in which two transistors T13 and T14 are added to the buffer circuit 52 according to Variation 1 illustrated in FIG. 7.

The transistor T13 is connected between the gate (point A) of the transistor T7 and the power supply (reference potential Vss), and supplies the reference potential Vss to the gate of the transistor T7 based on the pulse signal ed outputted from the transfer circuit in the same stage.

The transistor T14 is connected between the gate (point B) of the transistor T8 and the power supply (reference potential Vss), and supplies the reference potential Vss to the gate of the transistor T8 based on the pulse signal st outputted from the transfer circuit in the same stage.

In this variation, the transistors T11 and T12 are added in order to protect against floating of the gates of the transistors T7 and T8 when the output terminal out is changed from Low to High or from High to Low. As described above, since the transistors T7 and T8 are designed to have a large size, change in the waveform of the drive signal at the output terminal out is inputted to point A and point B through the parasitic capacitances (by coupling of the parasitic capacitances) of the transistors T7 and T8, and there is a possibility that the transistors T7 and T8 may be simultaneously turned on. Thus, the possibility is reduced by turning on the transistors T11 and T12 to maintain the potential at point A and point B at the reference potential Vss. It is to be noted that the buffer circuit 53 illustrated in FIG. 9 also has functionally the same configuration as the functional block illustrated in FIG. 4B in the above-described embodiment. In this variation, the ON potential output unit 44 is equivalent the circuit obtained by adding the transistors T9 and T10 and the capacitor C3 to the transistor T7. Also, the OFF potential output unit 46 is equivalent the circuit obtained by adding the transistors T11 and T12 and the capacitor C4 to the transistor T8.

Figure 10:
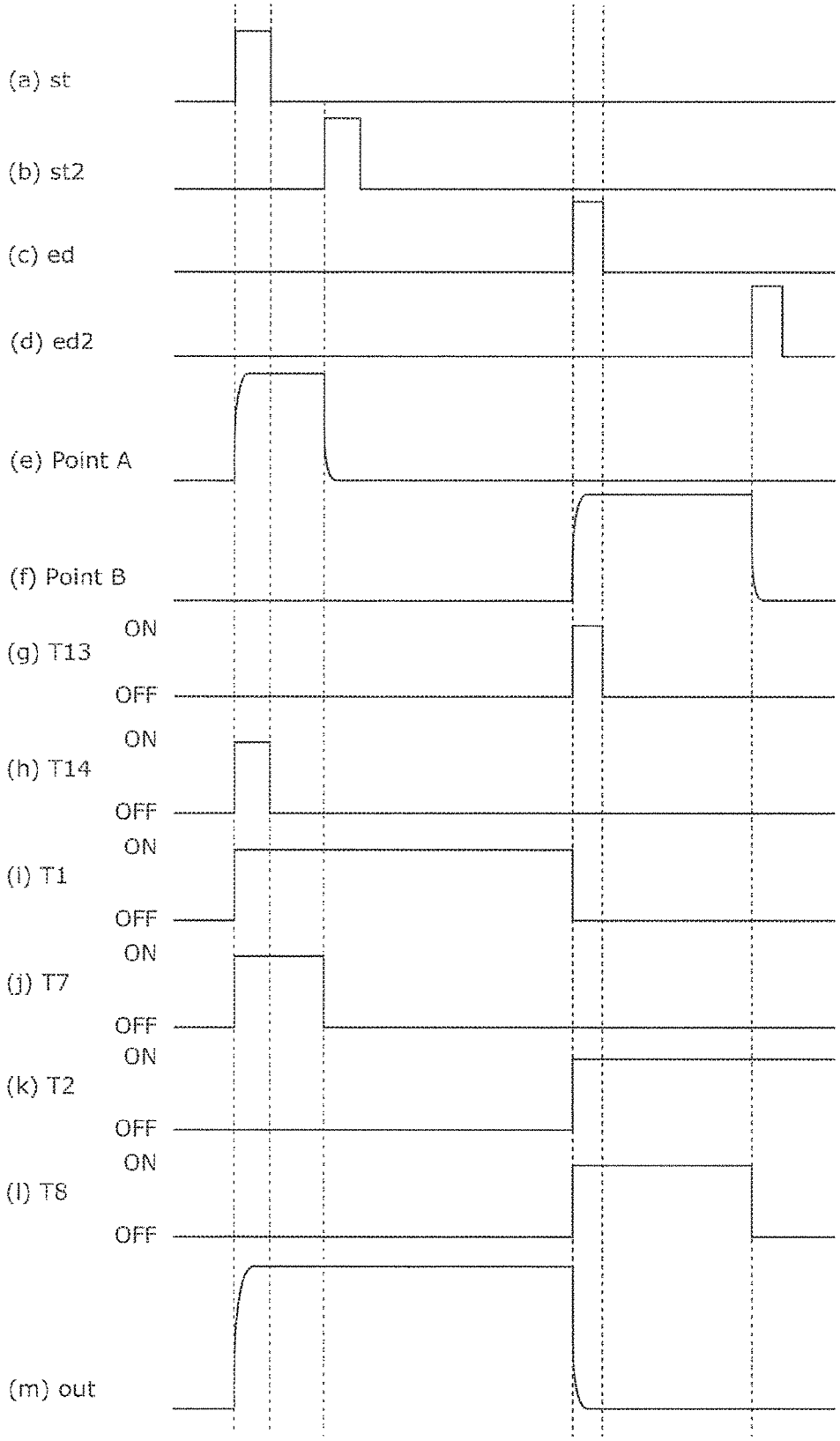
FIG. 10 is a timing chart illustrating the operation of the buffer circuit according to Variation 2 of the embodiment.
Figure 11:
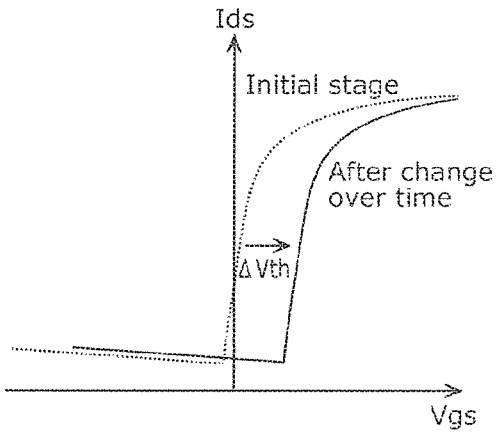
FIG. 11 is a graph illustrating the manner in which a threshold voltage of a transistor of a drive circuit in related art shifts.
Figure 12:
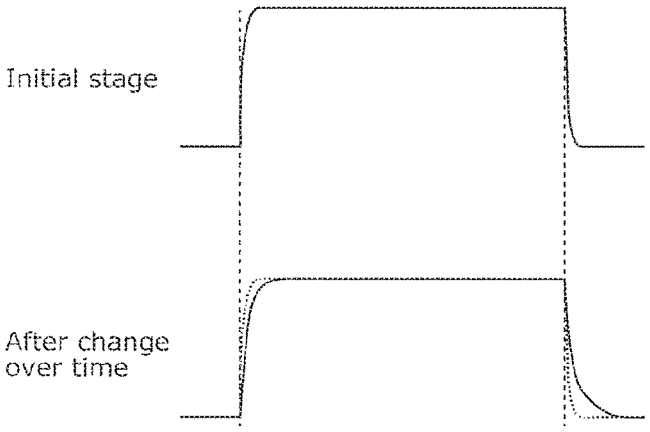
FIG. 12 is a graph illustrating roundness at a transient time in an output signal from the drive circuit in related art.

FIG. 10 is a timing chart illustrating the operation of the buffer circuit 53 according to this variation. FIG. 10 is equivalent the timing chart obtained by adding ON/OFF state ((g) of FIG. 10) of the transistor T13, and ON/OFF state ((h) of FIG. 10) of the transistor T14 to FIG. 8 which indicates the timing chart in Variation 1.

As seen from FIG. 10, although the transistor T7 is turned on when the output terminal out is changed from Low to High, the transistor T14 is turned on so that the transistor T8 is not turned on by coupling of the parasitic capacitances.

In addition, although the transistor T8 is turned on when the output terminal out is changed from High to Low, the transistor T13 is turned on so that the transistor T7 is not turned on by coupling of the parasitic capacitances.

As described above, similarly to the above-described embodiment, the drive circuit according to this variation includes the buffer circuit 53 including the first transistor (T1 or T2) and the second transistor (T7 or T8) that are connected in parallel between the power supply (power supply potential Vdd or Vss) and the output terminal out, and the first transistor (T1 or T2) and the second transistor (T7 or T8) are simultaneously turned on, then the second transistor (T7 or T8) is controlled to be turned off earlier than the first transistor (T1 or T2).

Thus, the first transistor (T1 or T2) and the second transistor (T7 or T8) are simultaneously turned on at a transient time, and the current driving capability of the buffer circuit 53 is increased, thus in contrast to the drive circuit in related art, in which only one transistor is turned on, decline in the current driving capability due to elapse of ON time of transistors is reduced. Consequently, a signal having a waveform with a sharp edge and reduced roundness at a transient time is outputted from the drive circuit 20, and when the signal is supplied to the pixel circuit, occurrence of an adverse effect, such as a variation in pixel or lighting defect due to a decreased threshold correction operation period is reduced.

Also, the buffer circuit 53 according to this variation includes auxiliary transistors T13 and T14 that maintain the second transistor (T7 or T8) at off when the voltage outputted from the output terminal out is changed.

Thus, when the voltage outputted from the output terminal out is changed, floating of the gate of the second transistor (T7 or T8) is avoided, and thus occurrence of failure such as turn-on of a transistor at timing of turn-off due to the parasitic capacitance of the second transistor (T7 or T8) is reduced.

Although the drive circuit according to the present disclosure based on the embodiment and the variations have been described above, the present disclosure is not limited to the embodiment and the variations. The embodiment and the variations to which various modifications which will occur to those skilled in the art are made, and another embodiment constructed by a combination of part of the components of the embodiment and the variations without departing from the spirit of the present disclosure is also included within the scope of the present disclosure.

For instance, although a pixel circuit, such as an organic EL panel as a target to be driven by the drive circuit has been exemplified in the above-described embodiment, without being limited to this, a target may be another type of a pixel circuit, such as a liquid crystal display (LCD), or an LED back light for LCD.

Also, although each pixel included in the pixel circuit 20 includes two transistors and one capacitor in the above-described embodiment, the pixel circuit 20 is not limited to such a circuit, and may be a circuit including three transistors or more and/or a circuit including two capacitors or more.

Also, although the drive scan circuit 40*a* that outputs power supply voltage signals (Vcc/Vss), and the write scan circuit 40*b* that outputs a selection signal Sel have been exemplified as a drive circuit in the above-described embodiment, the type of drive circuit is not limited to such a circuit, and may be another type of drive circuit that outputs various control signals or power supply voltage signals to the pixel circuit 20.

Also, although each buffer circuit included in the drive circuit is provided with the first transistor and the second transistor that are connected in parallel to both the output terminal out, and the positive-side power supply Vdd and the negative-side power supply Vss in the above-described embodiment, each buffer circuit may be provided with the first transistor and the second transistor that are connected in parallel to one of the output terminal out, and the positive-side power supply Vdd and the negative-side power supply Vss. Thus, the roundness at a transient time of one of rise and fall of each output signal from the drive circuit is reduced.

Also, the buffer circuit 42 operates with input of a pulse signal from the transfer circuit 41 that forms a shift register in the above-described embodiment. However, without being limited to such a pulse signal, the buffer circuit 42 may operate with input of a pulse signal from a pulse signal generation circuit including a general logic circuit.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is applicable to a drive circuit that outputs a drive signal having a waveform with a sharp edge and reduced roundness at a transient time, for instance, is applicable to a drive circuit that drives a pixel circuit such as an organic EL display panel.

The invention claimed is:

1. A drive circuit having an output terminal, the drive circuit comprising a buffer circuit that includes a first transistor and a second transistor that are connected in parallel between a power supply and the output terminal, wherein the first transistor and the second transistor are controlled such that after the first transistor and the second transistor are simultaneously turned on, the second transistor is turned off earlier than the first transistor.

2. The drive circuit according to claim 1, wherein the second transistor has a current driving capability greater than a current driving capability of the first transistor.

3. The drive circuit according to claim 1, wherein a plurality of buffer circuits are provided in stages, each of the plurality of buffer circuits being the buffer circuit, a plurality transfer circuits are provided in stages in correspondence with the plurality of buffer circuits provided in stages, the first transistor included in Nth-stage buffer circuit, among the plurality of buffer circuits provided in stages, is turned on based on one of rise and fall of a first control signal outputted from an Nth-stage transfer circuit among the plurality of transfer circuits provided in stages, and the second transistor included in the Nth-stage buffer circuit is turned on based on the one of the rise and fall of the first control signal outputted from the Nth-stage transfer circuit, and is turned off based on the other of the rise and fail of the first control signal.

4. The drive circuit according to claim 1, wherein a plurality of buffer circuits are provided in stages, each of the plurality of buffer circuits being the buffer circuit, a plurality transfer circuits are provided in stages in correspondence with the plurality of buffer circuits provided in stages, the second transistor included in an Nth-stage buffer circuit, among the plurality of buffer circuits provided in stages, is turned on and off based on a first control signal and a second control signal outputted from an Nth-stage transfer circuit and an (N+1)th and subsequent stage transfer circuit, respectively, among the plurality of buffer circuits provided in stages.

5. The drive circuit according to claim 4, wherein the second transistor included in the Nth-stage buffer circuit is turned on and off based on the first control signal outputted from the Nth-stage transfer circuit and the second control signal outputted from the (N+1)th-stage transfer circuit.

6. The drive circuit according to claim 1, wherein the buffer circuit further includes an auxiliary transistor that maintains the second transistor at off when a voltage outputted from the output terminal is changed.

7. The drive circuit according to claim 1, wherein the drive circuit supplies a drive signal to a pixel circuit including a plurality of pixels via the output terminal, and rise or fall of the drive signal indicates timing of start or end of specific processing for at least one of the plurality of pixels.

8. A drive circuit that outputs from an output terminal a drive signal that assumes an ON potential and an OFF potential, the drive circuit comprising an ON potential output holding unit and an ON potential output unit that are connected in parallel between a first power supply and the output terminal, and place the first power supply and the output terminal in a conducting state or a non-conducting state, wherein the ON potential output holding unit outputs the ON potential to the output terminal and holds the ON potential by maintaining the first power supply and the output terminal at a conducting state, and the ON potential output unit outputs the ON potential to the output terminal by placing the first power supply and the output terminal in a conducting state for a certain period after the ON potential output holding unit outputs the ON potential to the output terminal.

9. The drive circuit according to claim 8, further comprising an OFF potential output holding unit and an OFF potential output unit that are connected in parallel between a second power supply and the output terminal, and place the second power supply and the output terminal in a conducting state or a non-conducting state, wherein the OFF potential output holding unit outputs the OFF potential to the output terminal and holds the OFF potential by maintaining the second power supply and the output terminal at a conducting state, and the OFF potential output unit outputs the OFF potential to the output terminal by placing the second power supply and the output terminal in a conducting state for a certain period after the OFF potential output holding unit outputs the OFF potential to the output terminal.

* * * * *